United States Patent [19]

Crecelius et al.

[11] Patent Number: 4,872,571

[45] Date of Patent: Oct. 10, 1989

[54] CONTAINER POUR SPOUT WITH PEELABLE TAMPER-PROOF SEAL

[76] Inventors: Ross E. Crecelius, 7201 Christopher Dr., St. Louis, Mo. 63129; Patrick E. O'Neal, 1124 Klondike Rd.; David B. Crecelius, 1615 York St., both of Quincy, Ill. 62301

[21] Appl. No.: 299,780

[22] Filed: Jan. 23, 1989

[51] Int. Cl.[4] ..... B65D 41/62

[52] U.S. Cl. ..... 215/232

[58] Field of Search ..... 215/232; 220/359

[56] References Cited

U.S. PATENT DOCUMENTS 4,605,136 8/1986 Debetencourt ..... 215/232

4,789,082 12/1988 Sampson ..... 215/232

*Primary Examiner*—Donald F. Norton

*Attorney, Agent, or Firm*—Lockwood, Alex, Fitzgibbon & Cummings

[57] ABSTRACT

A container having an externally threaded pour spout on which an internally threaded cap is screwed. A tamper-proof, removable, membrane-like or diaphragm-like closure for the spout is secured to the circumferential lip of the spout with a peelable seal. The membrane-like closure has an elongated pull tab extending therefrom, by pulling on which the closure may be peeled off the end of the spout. The external threads on the spout are interrupted so as to provide a groove in which the pull tab resides out of engagement or interference with the external and internal threads on the spout and cap.

2 Claims, 1 Drawing Sheet

CONTAINER POUR SPOUT WITH PEELABLE TAMPER-PROOF SEAL

SPECIFICATION

This invention relates, generally, to innovations and improvements in readily removable, safety or tamper-proof seals for containers of the type having pour spouts and screw caps as their primary closures In order to assure customers that products such as motor oil, anti-freeze, insecticides, solvents, cooking oils, etc. have not been tampered with prior to use by the consumer, it has been customary to seal the mouths of the pour spouts of the containers for such products with membrane-like or diaphragm-like seals or closures. Conventionally, such seals remove by the consumer and require puncturing and pealing away most if not all of the closure or seal. Usually fragments of the closures are left adhering to the containers and have to be removed piece by piece.

The object of the present invention, generally stated, is the provision of a novel form of tamper-proof closure seals for containers of flowable contents which have pour spouts equipped with screw caps as the primary closures.

An important object of the invention is the provision of such tamper-proof seals or closures provided with pull tabs which may be used to peel away the closures even during the act of pouring out the contents so as to eliminate the chance of contamination while facilitating the removal of the tamper-proof seals.

The invention has particular utility with containers for motor oils which are usually completely emptied on being opened.

Certain other objects of the invention will become apparent in the light of the following detailed description of a preferred embodiment of the invention taken in conjunction with the accompanying drawings, wherein.

Figure 1:
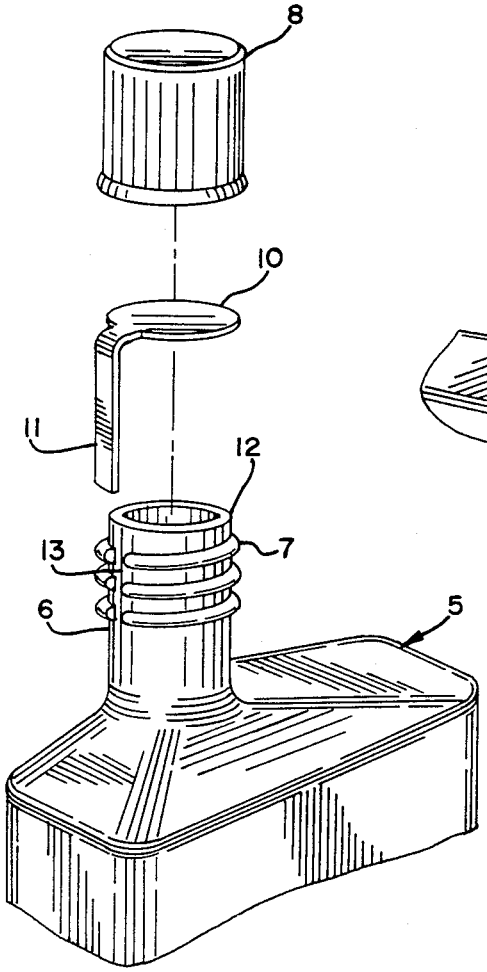
FIG. 1 is an exploded perspective view of an embodiment of the invention.

In the drawings, a container is indicated generally at 5 having an integrally formed pour spout 6 which is cylindrical in configuration and provided with external threads 7. The container 5 may be blow-molded from plastic material or it could be formed glass or metal. Flexible plastic containers of this type are widely used in one-quart size for motor oil.

An internally threaded screw cap 8 serves as the primary closure for the pour spout 6. However, the pour spout 6 is also provided with a tamper-proof or safety seal 10 in the form of a membrane-like or diaphragm-like disk from which an integrally formed pull tab 11 extends. The closure seal 10 may be formed from various types of thin membrane-like material including various plastics, paper-based material, metal foils and combinations or laminates of such thin sheet materials. The disk portion of the closure seal 10 will be sealed to the circumferential lip 12 and the spout 6 by a suitable contact adhesive material or by being heat sealed directly to the lip. The details of formation of the closure seal 10 and the various manners in which the same may be adhered or secured to the lip 12 with a peelable seal are well known in the prior art.

An important feature of the invention is to have the external thread 7 on the pour spout 6 interrupted so as to form a vertical or axially extending slot or groove 13 in the threads of sufficient width and depth to receive therein the pull tab 11. With this arrangement, the screw cap 8 can be applied to the spout 6 after the tamper-proof closure 10 has been sealed to the lip 12, without the pull tab 11 being engaged or disturbed by the threads on the interior of the cap 8.

As a further safety or tamper-proof feature, all but the end of the pull tab 11 may be sealed to the spout or neck 6 with a peelable seal. Thus, if the consumer on removal of the cap 8 finds that the pull tab 11 has been freed from the spout 6 this will serve as an indication that the package has been tampered with.

Figure 2:
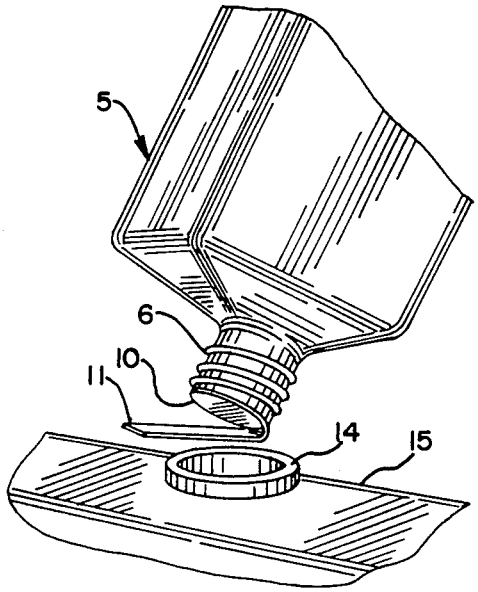
FIG. 2 is a perspective view illustrating the preferred manner for using the embodiment of the invention shown in FIG. 1.
Figure 3:
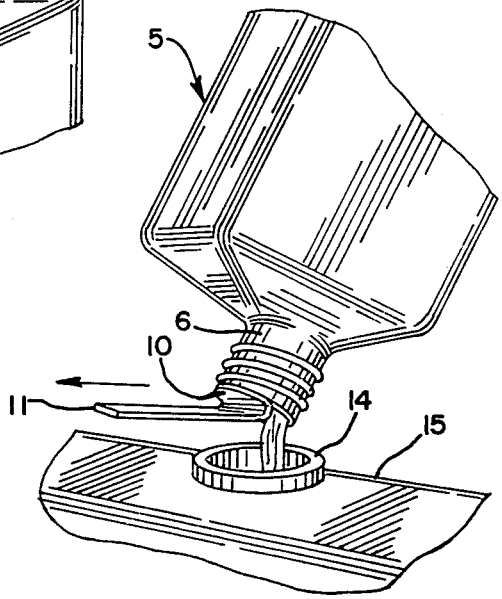
FIG. 3 is a perspective view similar to FIG. 2 showing the tamper-proof seal partially removed while the contents of the container are beginning to flow out from its pour spout.

In use, the membrane-like seal 10 may be removed from the container 5 in its upright position by pulling up on the pull tab 11 so as to peel the closure 10 off from the lip 12. However, particularly, in opening a quart container of motor oil, the preferred way of removing the closure 10 is illustrated in FIGS. 2 and 3. The pour spout 6 is held directly over the opening 14 (e.g. the oil fill pipe of a car) in a receptacle 15 with one hand of the user. The other hand of the user grasps the pull tab 11 and gently peels away the closure 10 as illustrated in FIG. 3. By removing the tamper-proof closure 10 in the particular manner illustrated in FIGS. 2 and 3, the flowable contents of the container 5 may be removed and transferred into another receptacle without the contents touching the user's hands and without the danger of foreign material entering the container 5 or contaminating the contents as they are poured.

If desired, the tamper-proof seal 10 may be only partially removed if the contents of the container 5 are not to be completely emptied out and then the disk 10 while still partially attached to the lip 12 may be replaced on the spout 6 along with the pull tab 11 so as to provide an additional measure of protection to that provided by the screw cap 8. It will be seen that this replacement or repositioning of the partially removed closure 10 will not interfere with the application of the screw cap 8.

What is claimed is:

1. In a container comprising a pour spout through which flowable contents may be poured, said spout having exterior threads, an internally threaded cap screwed onto said spout, and a membrane-like closure secured by a seal over the circumferential lip of said spout, the improvement which comprises, said membrane-like closure having an elongated pull tab by means which said membrane-like closure can be peeled off said lip, and said external threads on said spout being interrupted in a direction parallel to the axis of said spout so as to provide in said external threads a groove in which said tab may reside when said cap is screwed on said spout.

2. The improvement call for in claim 1, wherein said pull tab is secured to said spout with a seal except for a free end portion of said tab.

* * * * *

UNITED STATES PATENT AND TRADEMARK OFFICE

CERTIFICATE OF CORRECTION

PATENT NO. : 4,872,571

DATED : October 10, 1989

INVENTOR(S) : Ross E. Crecelius, et al.

It is certified that error appears in the above-identified patent and that said Letters Patent is hereby corrected as shown below:

Column 1, line 16, after "seals" insert --or closures are in the form of disks which are difficult to--.

Column 2, claim 1, line 5 thereof, after "a" insert --peelable--.

Column 2, claim 2, line 2 thereof, after "a" insert --peelable--.

Signed and Sealed this

Twenty-fifth Day of December, 199(

*Attest:*

HARRY F. MANBECK, JR.

*Attesting Officer*

*Commissioner of Patents and Trademarks*